US006292141B1

(12) United States Patent
Lim

(10) Patent No.: US 6,292,141 B1
(45) Date of Patent: Sep. 18, 2001

(54) DIELECTRIC-PATCH RESONATOR ANTENNA

(75) Inventor: Beng-Teck Lim, San Diego, CA (US)

(73) Assignee: Qualcomm Inc., San Diego, CA (US)

( * ) Notice: Subject to any disclaimer, the term of this patent is extended or adjusted under 35 U.S.C. 154(b) by 0 days.

(21) Appl. No.: 09/541,880

(22) Filed: Apr. 1, 2000

Related U.S. Application Data

(60) Provisional application No. 60/127,491, filed on Apr. 2, 1999.

(51) Int. Cl.[7] ..... H01Q 1/38

(52) U.S. Cl. ..... 343/700 MS; 343/873

(58) Field of Search ..... 343/700 MS, 702, 343/725, 785, 829, 873

(56) References Cited

U.S. PATENT DOCUMENTS

| | | | |
|---|---|---|---|
| 4,125,837 | 11/1978 | Kaloi | 343/700 |
| 4,125,838 | 11/1978 | Kaloi | 343/700 |
| 4,125,839 | 11/1978 | Kaloi | 343/700 |
| 4,162,499 | 7/1979 | Jones, Jr. et al. | 343/700 |
| 4,218,682 | 8/1980 | Yu | 343/700 |
| 4,329,689 | 5/1982 | Yee | 343/700 |
| 4,692,769 | 9/1987 | Gegan | 343/700 |
| 5,396,202 | 3/1995 | Scheck | 333/230 |
| 5,453,754 | 9/1995 | Fray | 343/789 |
| 5,557,293 | 9/1996 | McCoy et al. | 343/867 |
| 5,748,154 | 5/1998 | Yokota | 343/702 |
| 5,940,036 | 8/1999 | Oliver et al. | 343/700 |
| 5,952,972 | 9/1999 | Ittipiboon et al. | 343/700 |

FOREIGN PATENT DOCUMENTS

| | | | |
|---|---|---|---|
| 0372451 | 6/1990 | (EP) | H01Q/5/00 |
| 0747990 | 12/1996 | (EP) | H01Q/1/24 |
| 04134906 | 5/1992 | (JP) | H01Q/5/00 |
| 10126134 | 5/1998 | (JP) | H01Q/1/38 |

OTHER PUBLICATIONS

Drossos G. et al.; Switchable Cylindrical Dielectric Resonator Antenna; Electronics Letters; May 9, 1996; vol. 32; No. 10 pp. 862–864.

Haneishi et al.; "Broadband Circularly Polarized Planar Array composed of a pair of Dielectric Resonator Antenna"; May 9, 1985, vol. 21, No. 10, pp. 437–438.

Kishk, A. A. et al.; Broadband Stacked Dielectric Resonator Antennas; Electronics Letters; Aug. 31, 1989; vol. 25; No. 18; pp. 1232–1233.

Martin et al., "Dielectric Resonator Antenna Using Aperture Coupling," Electronic Letters, Nov. 22, 1990, vol. 26, No. 24, pp. 2015–2016.

Mongia, R. K. et al.; Circularly Polarised Dielectric Resonator Antenna; Electric Letters; Aug. 18, 1994; vol. 30; No. 17; pp. 1361–1362.

Patent Abstracts of Japan vol. 016, No. 403 (E–1254), Aug. 26, 1992 & JP 04 134906 A (Nippon Telegr & Teleph), May 8, 1992 Abstract; Figure 8.

*Primary Examiner*—Don Wong
*Assistant Examiner*—James Clinger
(74) *Attorney, Agent, or Firm*—Philip R. Wadsworth; Gregory D. Ogrod

(57) ABSTRACT

A dielectric-patch resonator antenna having a resonator formed from a dielectric material mounted on a ground plane with a conductive skirt, and a patch element disposed inbetween. The ground plane and patch are formed from conductive materials. First and second probes are electrically coupled to the resonator for providing first and second signals, respectively, to or receiving from the resonator. The first and second probes are spaced apart from each other. The first and second probes are formed of conductive strips that are electrically connected to the perimeter of the resonator and are substantially orthogonal with respect to the ground plane. A dual band antenna can be constructed by positioning and connecting two dielectric resonator antennas together. Each resonator in the dual band configuration resonates at a particular frequency, thereby providing dual band operation. The resonators can be positioned either side by side or vertically.

13 Claims, 8 Drawing Sheets

DIELECTRIC-PATCH RESONATOR ANTENNA

This application claims priority from U.S. Provisional Patent Application No. 60/127,491 filed Apr. 2, 1999 which is incorporated herein by reference.

BACKGROUND OF THE INVENTION

I. Field of the Invention

The present invention relates generally to antennas for wireless devices. More specifically, the present invention relates to a dielectric and patch resonator antenna assembly that uses a patch element disposed between a ground plane and a dielectric resonator to provide GPS signal reception.

II. Description of the Related Art

Recent advances in wireless communication devices, such as mobile and fixed phones for use in satellite or cellular communications systems, have motivated efforts to design antennas more suitable for use with such devices. New antennas are generally needed to meet design constraints being imposed on new devices including overall size, profile, weight, and manufacturability. Several factors are usually considered in selecting an antenna design for a wireless device or phone, such as the size, the bandwidth, and the radiation pattern of the antenna.

The radiation pattern of an antenna is a very significant factor to be considered in selecting, an antenna. In a typical application, a user of a wireless device such as a mobile phone needs to be able to communicate with a satellite or a ground station that can be located in a variety of directions relative to the user. Consequently, an antenna connected to the wireless device should preferably be able to transfer, transmit and/or receive, signals from may directions. That is, the antenna should preferably exhibit an omni-directional radiation pattern in azimuth and a wide beamwidth (preferably hemispherical) in elevation.

Another factor that must be considered in selecting an antenna for a wireless device is the antenna bandwidth. That is, the useful range of frequencies over which the antenna efficiently transfers signals without an undesirable amount of loss. As an example, a typical wireless phone transmits and receives signals at separate frequencies. For example, a Personal Communication Services or PCS type phone operates over a frequency band of 1.85–1.99 GHz. requiring a bandwidth of 7.29%. A typical cellular phone operates over a frequency band of 824–894 MHz which requires an 8.14% bandwidth. Some satellite communication systems may have even wider bandwidth requirements. Accordingly, antennas for wireless phones used in such systems must be designed to meet these larger bandwidths.

Currently, monopole antennas, patch antennas, and helical antennas are among the various types of antennas being used in satellite user terminals or phones and other wireless-type devices. These antennas, however, have several disadvantages, such as limited bandwidth and large size. These antennas also exhibit a significant reduction in gain at lower elevation angles (for example, around 10 degrees), which makes them undesirable for use in satellite phones where a given satellite used for communication may frequently be near this low elevation.

An antenna that appears attractive for use in wireless user terminals or phones is the dielectric resonator antenna. Generally, dielectric resonators are fabricated from low loss materials that have high permittivity. Until recently, dielectric resonator elements have only found use in microwave circuits, such as in filters and oscillators. However, dielectric resonator antennas have been proposed and designed for wireless applications as described in U.S. patent application Ser. No. 09/150,157 entitled "Circularly Polarized Dielectric Resonator Antenna" filed Sep. 9, 1998, assigned to the same assignee, and incorporated herein by reference.

Dielectric resonator antennas offer several advantages over other antennas, such as small size high radiation efficiency, and simplified coupling schemes for various transmission lines. The bandwidth can be controlled over a wide range by the choice of dielectric constant ($\in_r$), and the geometric parameters of the resonator. Such antennas can also be made in low profile configurations, making them more aesthetically pleasing than standard whip, helical, or other upright antennas. A low profile antenna is also less subject to damage than other upright style antennas. Therefore, dielectric resonator antennas appear to have significant potential for use, for example, in mobile or fixed wireless phones for satellite or cellular communications systems.

Another issue facing many wireless device designers is the use of or proposal to incorporate GPS capabilities in such devices as an added feature. GPS allows the provision of location information to a device user or for triggering other information relative to a users location. It also allows accurate location of the user by the communication system in an emergency or for providing other services. GPS location accuracy is in fact being required for future wireless devices by various governmental bodies.

The GPS operates in the L-band and requires the use of an antenna for those frequencies, especially where most wireless devices communicate in other frequency bands, such as listed above. Therefore, implementing GPS related signal processing and services necessitates an additional antenna and consumes extra room to position the additional GPS antenna within the device. While GPS can utilize a relatively small patch antenna element, it is still an inconvenience to manufacture a device with a completely separate antenna element. It is also very difficult and sometimes commercially impractical to allocate such extra space and position the patch in a manner that operation is not inhibited by other components within the wireless device, without making the device unacceptably bulky, or non-asthetic, not to mention dramatically more expensive. Space and component positioning is at a premium in most modern wireless devices and antenna assemblies. Size is considered a very large henderance to marketability. In some applications such as in the case of mobile satellite phones, any increase in size also negatively impacts aerodynamics of external antennas.

In any case, it is very inconvenient and sometimes impractical to manufacture antenna assemblies with multiple antennas having two or more signal leads per antenna element, along with associated cables, connectors, and matching circuits. Each item or component, including cables, added to multiple antenna structures consumes room, making the structure undesirably larger, and makes it more difficult to physically assemble. It is also evident that the more components involved in any assembly make it more costly to manufacture, and may decrease operational reproducibility and reliability.

What is needed is an antenna structure that can maintain a desired polarization configuration, provide efficiently tailored radiation patterns, while allowing a simplified signal transfer process for GPS signals that are also to be used by a wireless device.

SUMMARY OF THE INVENTION

The present invention is directed to a dielectric resonator antenna having a ground plane formed of a conductive material, a resonator formed from a dielectric material mounted on the ground plane, and a patch element formed of a conductive material disposed inbetween. The ground plane extends beyond the edge or periphery of the resonator. A ground plane is typically formed as a conductive layer of material on top of a support substrate such as a multi-layered printed circuit board material.

At least one, and generally two signal probes are electrically coupled to the resonator to provide first and second signals, respectively, to the resonator, and produce circularly polarized radiation in the antenna. Preferably, the resonator is substantially cylindrical, although rectangular, elliptical shapes or other shapes may be used as desired. The dielectric material may have a central axial opening therethrough. Also preferably, the first and second probes are spaced approximately 90 degrees apart around the perimeter of the resonator.

The invention is directed to a dual purpose dielectric resonator antenna, having a dielectric resonator mounted on patch element which uses a ground plane common to both.

BRIEF DESCRIPTION OF THE DRAWINGS

Further features and advantages of the invention, as well as the structure and operation of various embodiments of the invention, are described in detail below with reference to the accompanying drawings. In the drawings, like reference numbers generally indicate identical, functionally similar, and/or structurally similar elements, and the drawing in which an element first appears is indicated by the leftmost digit(s) in the reference number.

DETAILED DESCRIPTION OF THE PREFERRED EMBODIMENTS

I. Dielectric Resonators

Figure 1A:
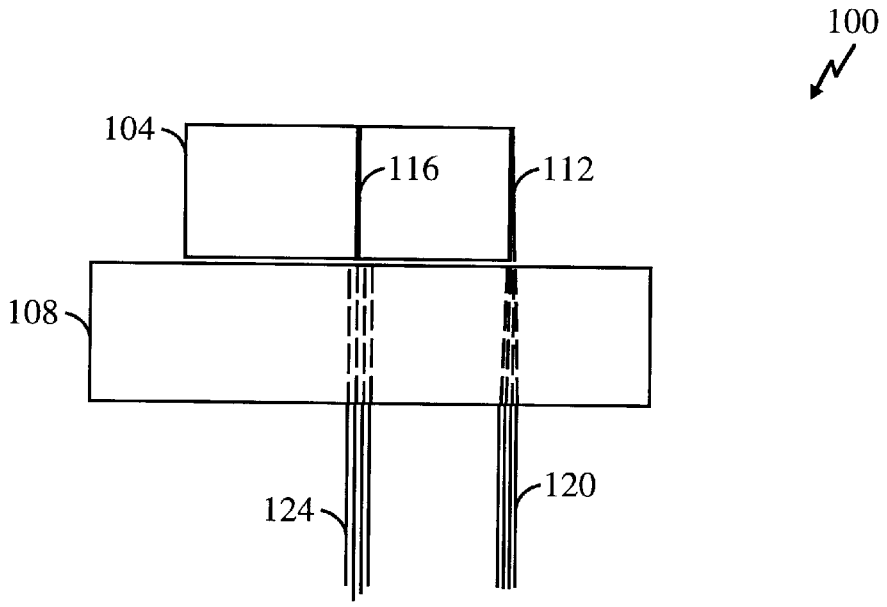
FIGS. 1A and 1B illustrate side and top views, respectively, of a cylindrical dielectric resonator antenna constructed and operating in accordance with one embodiment of the present invention.

Dielectric resonators offer attractive features as antenna elements. These features include their small size, mechanical simplicity, high radiation efficiency because there is no inherent conductor loss, relatively large bandwidth, ability to implement simple coupling schemes for a variety of commonly used transmission lines, and the advantage of obtaining different radiation characteristics using different modes of the resonator.

The size of a dielectric resonator is inversely proportional to the square root of $\in_r$, where $\in_r$ is the dielectric constant of the resonator. As a result, as the dielectric constant $\in_r$ increases, the size of the dielectric resonator decreases. Consequently, by choosing a high value of $\in_r$(say $\in_r$=10–100), the size (especially the height) of the dielectric resonator antenna can be made quite small, as desired for many new wireless applications.

The bandwidth of the dielectric resonator antenna is inversely proportional to $(\in_r)^{-p}$, where the value of p (p>1) depends upon the mode being used. As a result, the bandwidth of the dielectric resonator antenna decreases with an increase in the dielectric constant. It must be noted, however, that the dielectric constant is not the only factor determining the bandwidth of a dielectric resonator antenna. The other factors affecting the bandwidth of the dielectric resonator are its shape and dimensions (height, length, diameter, etc.), as would be known.

One advantage for a dielectric resonator antennas is a lack of inherent conductor loss. This low loss leads to high radiation efficiency of the antenna.

The resonant frequency of a dielectric resonator antenna can be determined by computing the value of normalized wavenumber $k_0\alpha$. The wavenumber $k_0\alpha$ is given by the relationship $k_0\alpha=2\pi f_0/c$, where $f_0$ is the resonant frequency, $\alpha$ is the radius of the cylinder, and c is the velocity of light in free space. However, if the value of $\in_r$ is very high, ($\in_r$>100), the value of the normalized wavenumber varies with $\in_r$, according to the relationship:

$$k_0 a \propto \frac{1}{\sqrt{\varepsilon_r}}, \tag{1}$$

for a given aspect ratio of a dielectric resonator.

For high values of $\in_r$, the value of the normalized wavenumber as a function of the aspect ratio (height(H)/2*radius(a)) can be determined for a single value of $\in_r$. However, if the $\in_r$ of the material used is not very high, the relationship shown in equation. (1) does not hold exactly. If the value of $\in_r$ is not very high, computations are required for each different value of $\in_r$. By comparing results from numerical methods available for different values of $\in_r$, it has been found that the following empirical relationship can be used as a good approximation to describe the dependence of the normalized wavenumber as a function of $\in_r$:

$$k_0 a \propto \frac{1}{\sqrt{\varepsilon_r X}}, \tag{2}$$

where the value of X is found empirically from the results of the numerical methods.

The impedance bandwidth of a dielectric resonator antenna is defined as the frequency bandwidth in which the input Voltage Standing Wave Ratio (VSWR) of the antenna is less than a specified value S. VSWR is a function of an incident wave and a reflected wave in a transmission line, and it is a well known terminology used in the art. The impedance bandwidth ($BW_i$) of an antenna, which is matched to a transmission line at its resonant frequency, is related to the total unloaded Q-factor ($Q_u$) of a dielectric resonator by the relationship:

$$BW_i = \frac{S-1}{Q_u\sqrt{S}} \tag{3}$$

Note that Q is proportional to the ratio of the energy stored to the energy lost in heat or radiation, and it is a well known terminology used in the art. For a dielectric resonator, which has a negligible conductor loss compared to its radiated power, the total unloaded Q-factor ($Q_u$) is related to the radiation Q-factor ($Q_{rad}$) by the relation:

$$Q_u \approx Q_{rad} \tag{4}$$

Numerical methods are required to compute the value of the radiation Q-factor of a dielectric resonator. For a given mode the value of the radiation Q-factor depends on the aspect ratio and the dielectric constant of a resonator. It has been shown that for resonators of very high permittivity. $Q_{rad}$ varies with $\in_r$ as $$Q_{rad} \alpha (\in_r)^p, \tag{5}$$

where the permitivity (p)=1.5, for modes that radiate like a magnetic dipole; p=2.5, for modes that radiate like an electric dipole; and p=2.5, for modes that radiate like a magnetic quadrupole.

II. Dielectric Resonator Antenna

Figure 1B:
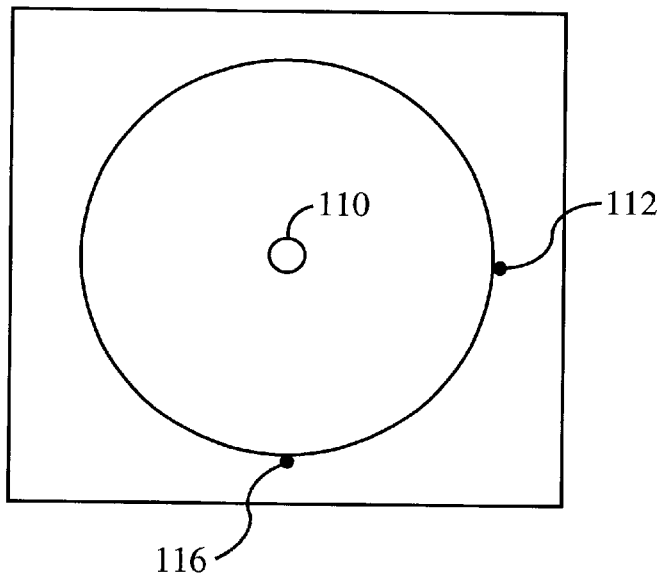

Using the above and known principles of antenna designing a dielectric resonator antenna can be constructed as disclosed in U.S. patent application Ser. No. 09/150,157, discussed above. FIGS. 1A and 1B illustrate a side view and a top view, respectively, of a dielectric resonator antenna 100. Dielectric resonator antenna 100 includes a resonator 104 formed from a dielectric material mounted on a ground plane 108 formed from a conductive material. In FIG. 1, resonator 104 is shown having a cylindrical shape. First and second probes or conductive leads 112 and 116, respectively, are electrically connected to the dielectric resonator. The first and second probes provide the dielectric resonator with two signals that have substantially equal magnitudes, but are 90° out of phase with respect to each other.

Resonator 104 is tightly mounted on ground plane 108. In one embodiment, resonator 104 is attached to ground plane 108 by means of an adhesive, preferably an adhesive having conductive properties. Alternatively, resonator 104 may be attached to ground plane 108 by a screw, bolt or other known fastener (shown in FIG. 2B) extending through an opening 110 along the center axis of resonator 104 for the modes that radiate like a magnetic dipole and into ground plane 108. Since a null exists at the center axis of resonator 104, the fastener will not interfere with the radiation pattern of antenna 100 in any substantial manner.

In order to prevent a degradation of the performance of the dielectric resonator antenna, including bandwidth and radiation pattern, it is necessary to minimize any gap or separation between resonator 104 and ground plane 108. This is preferably achieved by tightly mounting resonator 104 on ground plane 108. Alternatively. a gap between resonator 104 and ground plane 108 can by filled by a pliable or a malleable conductive material. If resonator 104 is loosely mounted on ground plane 108, there may remain an unacceptable amount of separation between the resonator and the ground plane, which can degrade the performance of the antenna by distorting the VSWR, resonant frequency, and radiation pattern.

Feed probes 112 and 116 arc electrically connected to resonator 104 through passages in ground plane 108. Generally, feed probes (shown in FIG. 2A) are formed using a metal strip axially aligned with and connected to the perimeter of resonator 104. Feed probes may comprise extensions of the inner conductors of coaxial cables 120 for example, the outer conductor of which may be electrically connected to ground plane 108. Coaxial cable 120 may be connected to radio transmit and receive circuits (not shown) in a known manner.

Feed probes 112 and 116 are positioned substantially orthogonal to ground plane 108, and provide signals to resonator 104. The first and second signals have substantially equal amplitude. but are formed to be out of phase with respect to each other by 90 degrees. When resonator 104 is fed by two signals having equal magnitude, but which are out of phase with respect to each other by 90 degrees, two magnetic dipoles that are substantially orthogonal to each other are produced above the ground plane. The orthogonal magnetic dipoles produce a circularly polarized radiation pattern.

In one embodiment, resonator 104 is formed from a ceramic material, such as barium titanate, which has a high dielectric constant $\in_r$. As noted before, the size of the resonator is inversely proportional to $\sqrt{\in_r}$. Therefore, by choosing a high value of $\in_r$, resonator 104 may be made relatively small. However, other dielectric materials having similar properties can also be used, and other sizes are allowed depending on the design constraints and desired features for specific applications.

Antenna 100 has a significantly lower than say a quadrafilar helix antenna operating at the same frequency band. For example, a dielectric resonator antenna operating at S-band frequencies has a significantly lower than a quadrafilar helix antenna also operating at S-band frequencies. This lower height makes a dielectric resonator antenna more desirable in many wireless phone applications, especially for fixed terminal use.

Tables I and II below compare the dimensions (height and diameter) of a dielectric resonator antenna with a typical quadrafilar helix antenna operating at L-band frequencies (1–2 GHz range) and S-band frequencies 2–4 GHz range), respectively.

TABLE I

| Antenna type | Height | Diameter |
|---|---|---|
| Dielectric resonator antenna (S-band) | 0.28 inches | 2.26 inches |
| Quadrafilar helix antenna (S-band) | 2.0 inches | 0.5 inches |

TABLE II

| Antenna type | Height | Diameter |
|---|---|---|
| Dielectric resonator antenna (L-band) | 0.42 inches | 3.38 inches |
| Quadrafilar helix antenna (L-band) | 3.0 inches | 0.5 inches |

Tables I and II show that, although a dielectric resonator antenna has a smaller height than a quadrafilar helix antenna operating at the same frequency band, a dielectric resonator antenna has a larger diameter than a quadrafilar helix antenna. In other words, the advantage gained by the reduction in height of a dielectric resonator antenna might appear to be offset by a larger diameter in some applications. In reality, a larger diameter is not of a great concern in most applications, because the primary goals of this antenna design is to obtain a low profile. A dielectric resonator antenna of this type could be built into a car roof without significantly altering the roof line. Similarly, an antenna of this type could be mounted on a remotely located fixed phone boot of a wireless satellite telephone communication system.

Furthermore, antenna 100 provides significantly lower loss than a comparable quadrafilar helix. This due to the fact that there is no conductor loss in dielectric resonators, hereby leading to high radiation efficiency. As a result, antenna 100 requires a lower power transmit amplifier to achieve the same power output, and a lower noise figure receiver than would be required for a comparable quadrafilar helix antenna.

Reflected signals from ground plane 108 can destructively add to the radiated signals from resonator 104. This is often referred to as destructive interference, which has the underisable effect of distorting the radiation pattern of antenna 100. In one embodiment, the destructive interference is reduced by forming a plurality of slots in ground place 108. These slots alter the phase of the reflected waves, thereby preventing reflected waves from destructively summing and distorting the radiation pattern of antenna 100.

The field around the edge of ground plane 108 also interferes with the radiation pattern of antenna 100. This interference can be reduced by serating or otherwise forming discontinuities in the edge of ground plane 108. Serating the edge of ground plane 108 reduces the coherency of the fields near the edge of ground plane 108, which reduces the distortion of the radiation pattern by making antenna 100 less susceptible to the surrounding fields.

In actual operation, two separate antennas are often desired for transmit and receive capabilities. For example, in a satellite telephone system, a transmitter may be configured to operate at L band frequencies and a receiver may be configured to operate at S band frequencies. In that case, an L band antenna may operate solely as a transmit antenna and an S band antenna may operate solely as a receive antenna. As is readily understood, other frequencies and signal transfer functions can be assigned to each antenna, as desired.

Figure 2A:
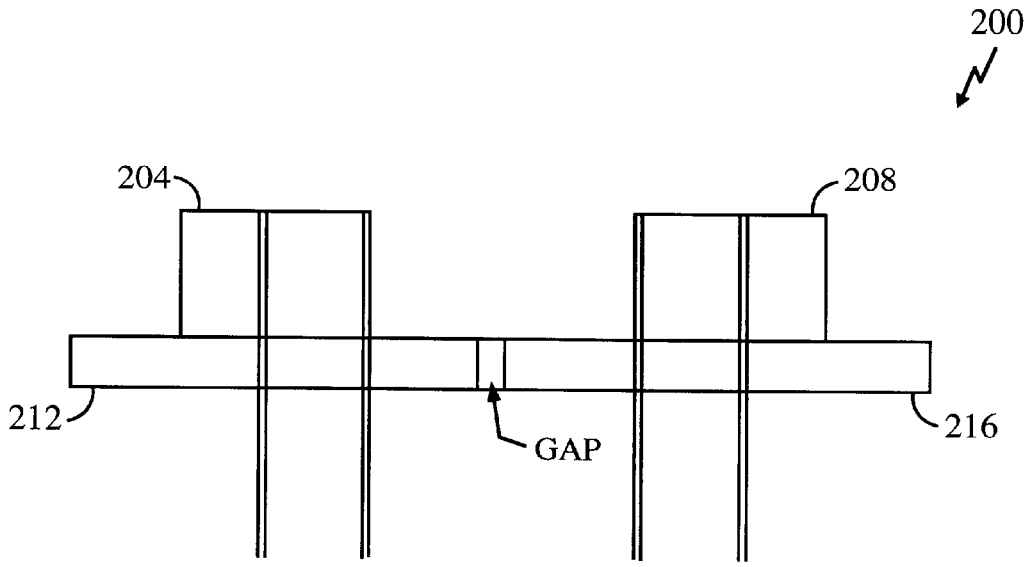
FIG. 2A illustrates an antenna assembly comprising two dielectric resonator antennas connected side-by-side.

FIG. 2A illustrates an antenna assembly 200 comprising two antennas 204 and 208. Antenna 204 is an L band antenna operating solely as a transmit antenna, while antenna 208 is an S band antenna operating solely as a receive antenna. Alternatively, the L band antenna can operate solely as a receive antenna, while the S band antenna can operate solely as a transmit antenna. Antennas 204 and 208 may have different diameters depending on their respective dielectric constants $\in_r$ and the frequencies of interest for which they are to be used.

Antennas 204 and 208 are connected together along ground planes 212 and 216. Since antenna 204 operates as a transmit antenna, the radiated signal from antenna 204 excites ground plane 216 of antenna 208. This causes undesirable electromagnetic coupling between antennas 204 and 208. The electromagnetic coupling can be minimized by selecting an optimum gap 218 between ground planes 212 and 216. The optimum width of gap 218 can be determined experimentally. Experimental results have shown that the electromagnetic coupling between antennas 204 and 208 increases if gap 218 is greater or less than the optimum gap spacing. The optimum gap spacing is a function of the operating frequencies of antennas 204 and 208 and the size of ground planes 212 and 216. For example, it has been determined that for an S-band antenna and an L-band antenna configured side-by-side as illustrated in FIG. 3A, the optimum gap spacing is 1 inch; that is, ground planes 212 and 216 should be separated by 1 inch for good performance.

Figure 2B:
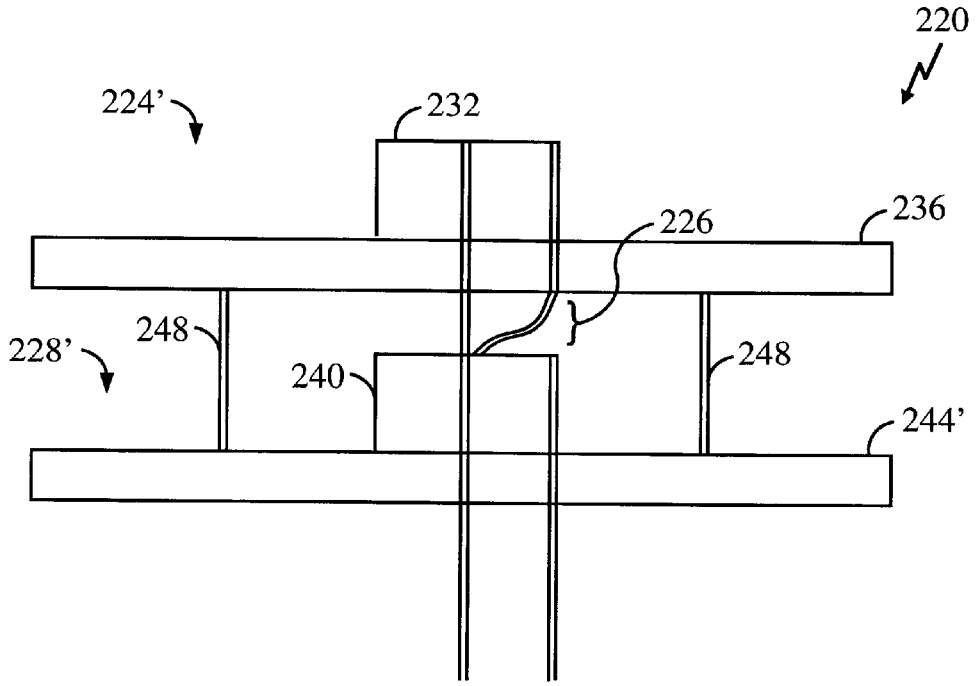
FIG. 2B illustrates an antenna assembly comprising two stacked dielectric resonator antennas connected vertically.

Alternatively, an S-band antenna and an L-band antenna can be stacked vertically. FIG. 2B shows an antenna assembly 220 comprising an S-band antenna 224 and an L-band antenna 228 stacked vertically along a common axis. Alternatively, antennas 224 and 228 may be stacked vertically, but not along a common axis, that is, they may have their central axes offset from each other. Antenna 224 comprises a dielectric resonator 232 and a ground plane 236, and antenna 228 comprises a dielectric resonator 240 and a ground plane 244. Ground plane 236 of antenna 224 is placed on top of dielectric resonator 240 of antenna 228. Non-conducting support members 248 fix antenna 224 in spaced relation to antenna 228 with a gap 226 between ground plane 236 and resonator 240.

Figure 2C:
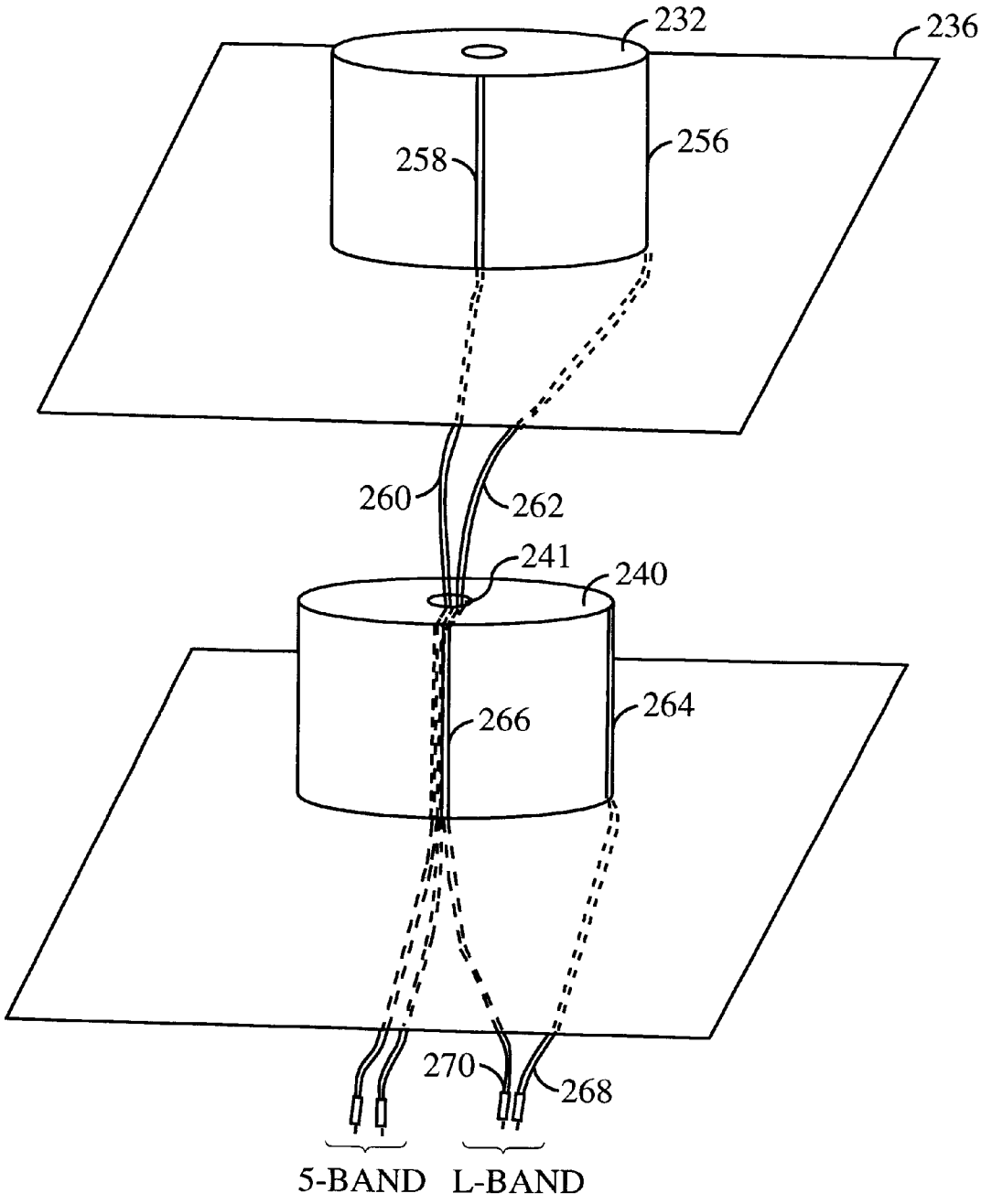
FIG. 2C shows the feed probe arrangement of the stacked antenna assembly of FIG. 2B

FIG. 2C shows the feed probe arrangement of the stacked antenna assembly of FIG. 2B in more detail. Upper resonator 232 is fed by feed probes 256 and 258. Conductors 260 and 262, which connect the feed probes to transmit/receive circuitry (not shown), extend through central opening 241 in lower resonator 240. Lower resonator 240 is fed by teed probes 264 and 266, which, in turn, are connected to the transmit/receive circuitry by conductors 268 and 270. In the exemplary embodiment shown, upper resonator 232 operates on the S-Band, while lower resonator 240 operates on L-Band. It will be apparent to those skilled in the relevant art that these band designations are only exemplary. The resonators can operate on other bands. Additionally, the S-Band and L-Band resonators can be reversed, if desired.

An optimum gap spacing should be maintained between antennas 224 and 228 to reduce coupling between the antennas. As with the previously described embodiment, this optimum gap spacing is determined empirically. For example, it has been determined that for an S-band antenna and an L-band antenna configured vertically as illustrated in FIGS. 2B and 2C, the optimum gap 226 is on the order of 1 inch, that is, ground plane 236 should be separated from dielectric resonator 240 by about 1 inch.

The dielectric resonator antenna is suitable for use in satellite phones (fixed, portable, or mobile), including phones having antennas mounted on various structures or flat surfaces (for example, an antenna mounted on the roof or other surface of a car). These applications require that the antenna operate at a high gain at low elevation angles. Unfortunately, antennas in use today, such as patch antennas and quadrafilar helix antennas do not exhibit high gain at low elevation angles. For example, patch antennas exhibit −5 dB gain at around 10 degrees elevation. In contrast, dielectric resonator antennas of the type to which this invention is directed exhibit −1.5 dB gain at around 10 degrees elevation, thereby making them attractive for use as low profile antennas in satellite phone systems.

Another noteworthy advantage of a dielectric resonator antenna is its ease of manufacture. A dielectric resonator antenna is easier to manufacture than either a quadrafilar helix antenna or a microstrip patch antenna, thus, reducing overall costs for wireless device manufacturing.

Table III lists parameters and dimensions for an exemplary L band dielectric resonator antenna.

TABLE III

| | |
|---|---|
| Operating frequency | 1.62 GHz |
| Dielectric constant | 36 |
| ground plane dimension | (3 inches) × (3 inches) |

Figure 3:
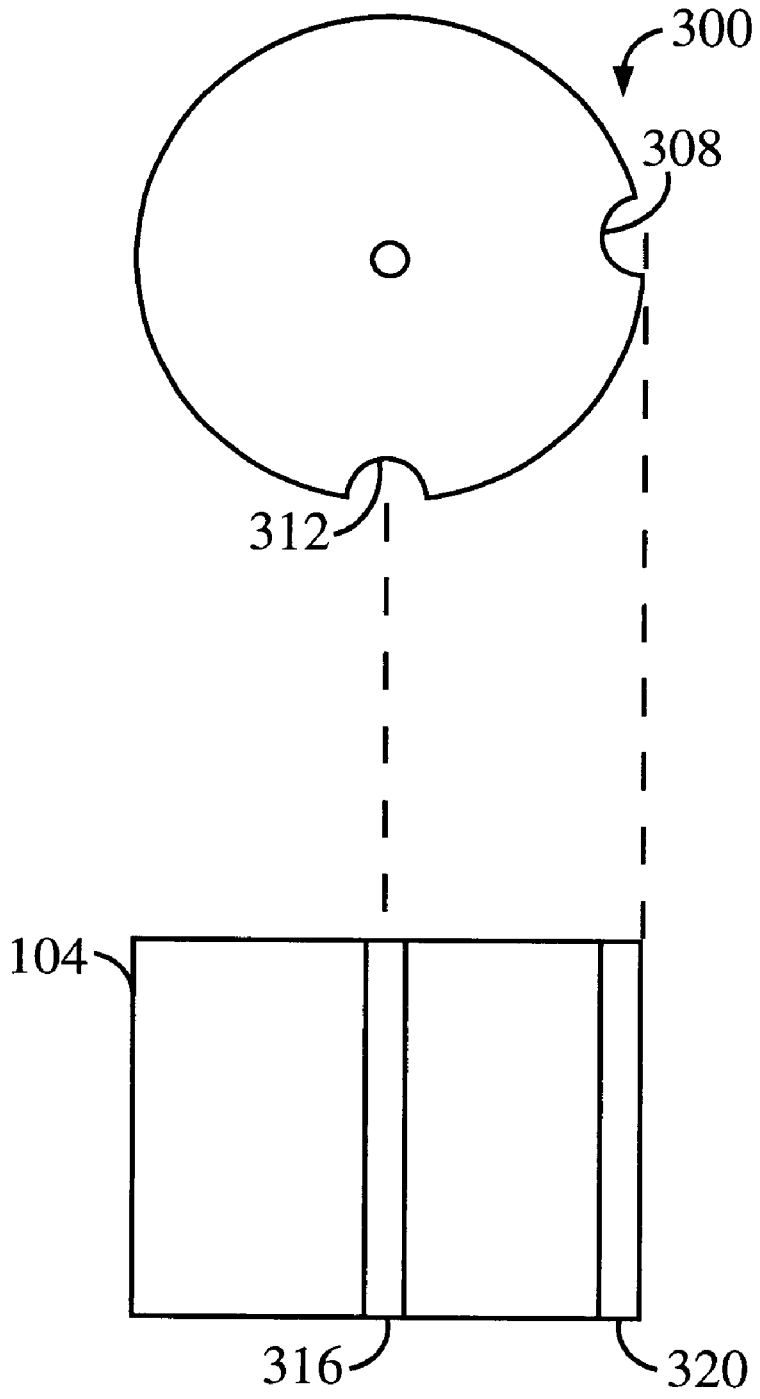
FIG. 3 illustrates a circular plate sized to be placed under a dielectric resonator.

FIG. 3 shows a conductive circular plate 300 sized to be placed between dielectric resonator 104 and ground plane 108. Circular plate 300 electrically connects dielectric resonator 104 to the ground plane. Circular plate 300 reduces the dimensions of any air gap between dielectric resonator 304 and ground plane 108, thereby inhibiting deterioration of the antenna's radiation pattern. Circular plate 300 includes two semi-circular slots 308 and 312 at its perimeter. Slots 308 and 312, however, can also have other shapes. Slots 308 and 312 are spaced apart from each other along a circumference by 90 degrees and are sized to receive appropriately shaped feed probes. Dielectric resonator 104 includes two notches 316 and 320 at its perimeter. Each notch is sized to receive a feed probe and is coincident with a slot of circular plate 300. Slots 316 and 320 can also be plated with conductive material to attach to the feed probes.

III. Single Feed DRA

It has also been discovered that shaping the dielectric resonator material in an appropriate fashion, non-circular with an offset axis feed point, or using a slot or other physical element, the modes desired for a polarized antenna can be separated. Therefore, a single electrical feed element can be used on such structures to achieve the desired polarization modes. The present invention recognizes that such single feed elements may be provided and is not limited to the two feed structure being described above for purposes of clarity in illustration. It is anticipates that the single feed will be preferred for some applications, but difficult to implement in others.

IV. Preferred Embodiments of the Invention

The dielectric resonator and stacked antenna designs discussed above are improvements over the art, providing: low profile, small-sized antennas for satellite communication applications, with simplified attachment to a PCB feed and for mounting elements such as power amplifiers and so forth. This arrangement allows for integration of other antenna types along the dielectric resonator antenna axis , thereby allowing for multifunction, multi-band performance in a single low profile assembly.

However, there also exist other antenna applications that do not rely on the more precise circularly polarized signal designs for assuring efficient or lower loss signal reception, but that can use a simple patch type antenna. One such application is the use of the Global Positioning System (GPS) to obtain accurate position location information for a wireless device user. There are many new proposed services being offered to prospective wireless device users , such as in the field of mobile telephones, that not only provide position location, but other information associated with that position. There are other communication systems or signal broadcasting processes for which a simple patch antenna element may also suffice.

Applicant has discovered that a new structure and technique can be used in combination with the dielectric resonator and the ground plane to create an dual purpose compact antenna structure. This new technique achieves an improved multiple use configuration making multiple frequency/purpose antenna structures more efficient, and lower profile. This is accomplished in a low cost highly efficient structure that is very amenable to low cost manufacturing and automated assembly processes.

The new antenna structure is achieved through the creation of a patch antenna using the ground plane of the dielectric resonator antenna as a common ground plane and support mechanism. In this configuration, a conductive patch element is mounted on the antenna assembly ground plane or formed as part of the ground plane structure, adjacent to and between the ground plane and the dielectric resonator. The patch area can be adjusted in size to achieve a desired level of operation or signal characteristics for the various frequencies of interest. It is contemplated that one implementation is to create an L-band patch element. Such a combination allows the incorporation of antenna elements useful for implementing location and time processing using, services such as GPS and for communication services, especially using satellites, in one compact efficient package.

Figure 4:
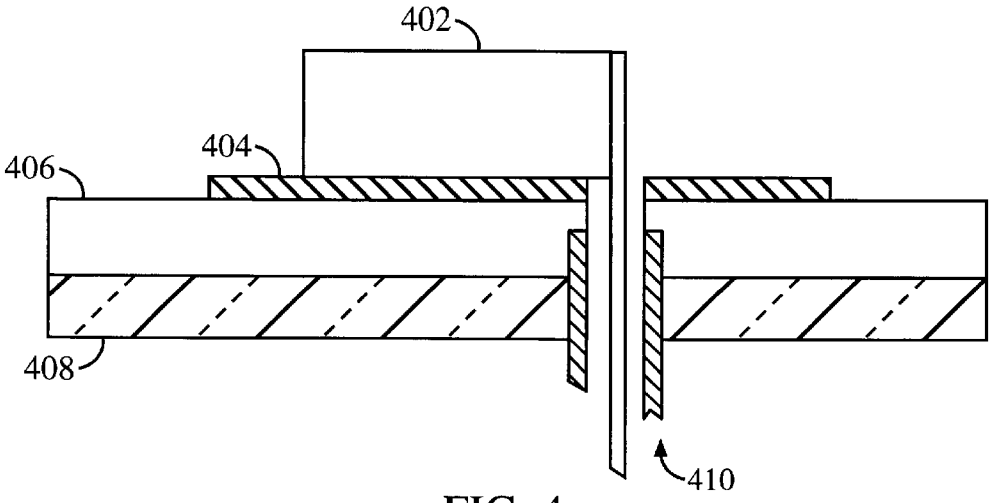
FIG. 4 illustrates a side view of an antenna assembly constructed and operating according to the present invention in which a patch element is incorporated with a dieletric resonator on a common ground plane.
Figure 5:
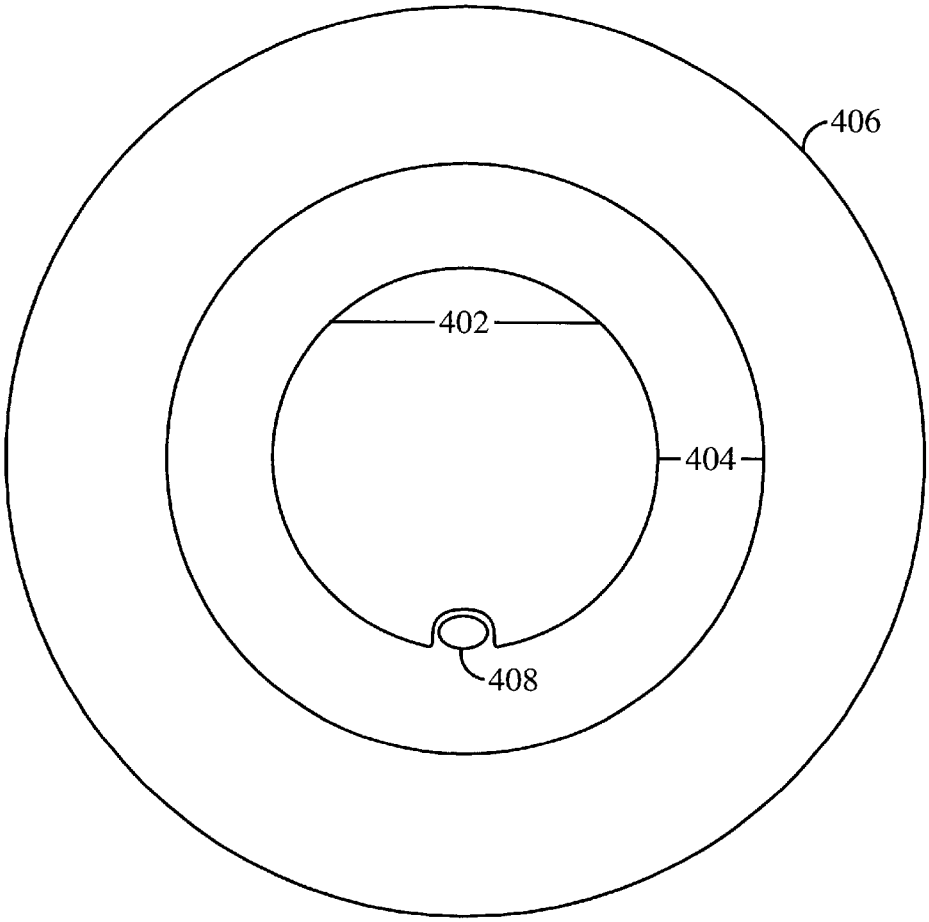
FIG. 5 illustrates a top view of the antenna assembly of FIG. 4.

The use of a patch antenna element with a single cylindrical dielectric resonator is illustrated in a side view in FIG. 4. and in a top view in FIG. 5. In FIGS. 4 and 5, a cylindrical, or other desired shape, dielectric resonator element 402 is disposed on a ground plane 406, as previously discussed above using known techniques. In addition, a conductive patch 404 is also disposed on ground plane 406, and it is positioned between the dielectric resonator and the ground plane, and it extends beyond the edges of the reo0nator, since it operates at a different frequency.

The ground plane in this configuration is circular to match the shape of dielectric resonator 402, although this is not necessary, as would be known. The ground plane can have a more elongated shape or have various serations and variations in geometry along its outer edges. However, for more efficient operation as a patch like element, the edge variations are typically kept to a minimum, as would be known.

Ground plane 406 is generally disposed on a support substrate 408. As desired , various discrete components and known elements or devices such as low noise amplifiers can be mounted on the side opposite the ground plane to provide low loss interconnections to the dielectric resonator, and the patch element, and improve signal transfer performance. The ground plane is made the appropriate size or are and dimensions based on factors known to those skilled in the art of antenna design for use with the resonator or the patch element.

In this latter case, the substrate is typically manufactured in the form of a multi-layered printed circuit board (PCB) type of structure having a conductive material deposited on one surface to form the ground plane. Various patterned electrical conductors are deposited, etched, or otherwise formed thereon and therein (intermediate layers) using well known circuit board techniques, for transferring signals and interconnecting components to be used with the antenna.

When dielectric resonator 402 is placed on ground plane 406 even with patch 404 present, it will behave in the manner described above to form a dielectric antenna resonator antenna, while the patch and ground plane will function as a GPS (or other desired communication system use) antenna.

A feed probe 410 is used to transfer signals for the dielectric resonator, and it is proximately coupled to the patch clement. At one pre-selected frequency based on physical size and other factors discussed above, the dielectric resonator resonates and the metal patch acts as part of the appropriate ground plane. This provides the desired antenna a wireless device would use to transfer communication signals or otherwise receive desired signals from some source. Then, when signal transfer elements are adjusted to operate at another appropriate frequency, say in the L-band for GPS signals, the resonator no longer resonates at such frequencies, but the patch formed by the metallic patch layer and the ground plane does, and signals are transferred at this new frequency using the patch.

While a single feed probe 410 in the form of a coaxial structure is illustrated in FIGS. 4 and 5 for purposes of clarity, the two-feed structure previously discussed and shown could also be used. In that configuration either one probe could be used to interact or couple to the patch element, or both probes could be used in combination, possibly to achieve a circularly polarized patch element for some applications.

Figure 6:
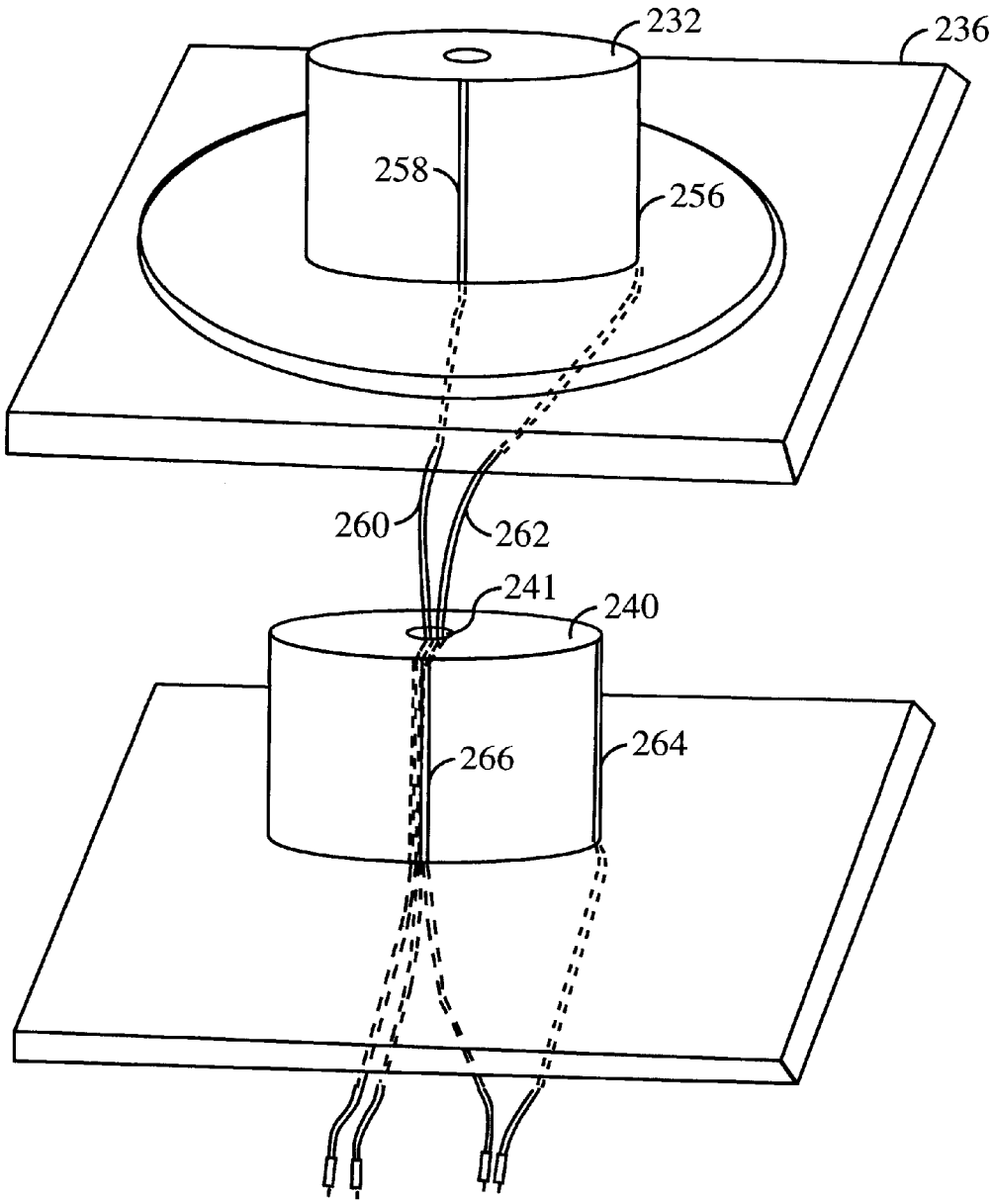
FIG. 6 illustrates a side view of the stacked antenna assembly of FIG. 2C using a patch element with the upper dielectric resonator.

FIG. 6 shows the stacked antenna assembly of FIG. 2B, but with a patch element 604 added to the upper antenna. In the exemplary embodiment shown, upper resonator 232 operates on the S-Band, while lower resonator 240 operates on the L-Band. It will be apparent to those skilled in the relevant art that these band designations are only exemplary, and that the resonators can operate on other bands. However, with the S-Band antenna having a smaller diameter dielectric resonator , an L-Band patch is accommodated very easily.

The implementation of a dielectric-patch resonator antenna was tested using a cylindrical piece of dielectric material with a radius of 0.27 inches and a height of 0.425 inches as a model. The corresponding ground plane/patch element was formed from conductive material that was 0.15 inches high or thick, and with a radius of 1.0 inches. However, those skilled in the art will readily recognize that the patch element need not be circular and that other geometric and non-geometric shapes are well known for use as patch shapes, say for GPS signal reception. It is also not required to have a circular shape to exactly match the configuration of the dielectric resonator element , which as discussed briefly above, which can also have other cross-sections, such as rectangular, elliptical, or even triangular.

The expected resonant frequencies for the elements being employed were 2.48 GHz for the dielectric resonator. and 1.6 ( Ci Iz for the patch antenna. However. the dielectric resonator acts as a 'supersubstrate' for the patch antenna, and that can alter the resonant frequency which can be accounted for in designing an antenna.

Figure 7:
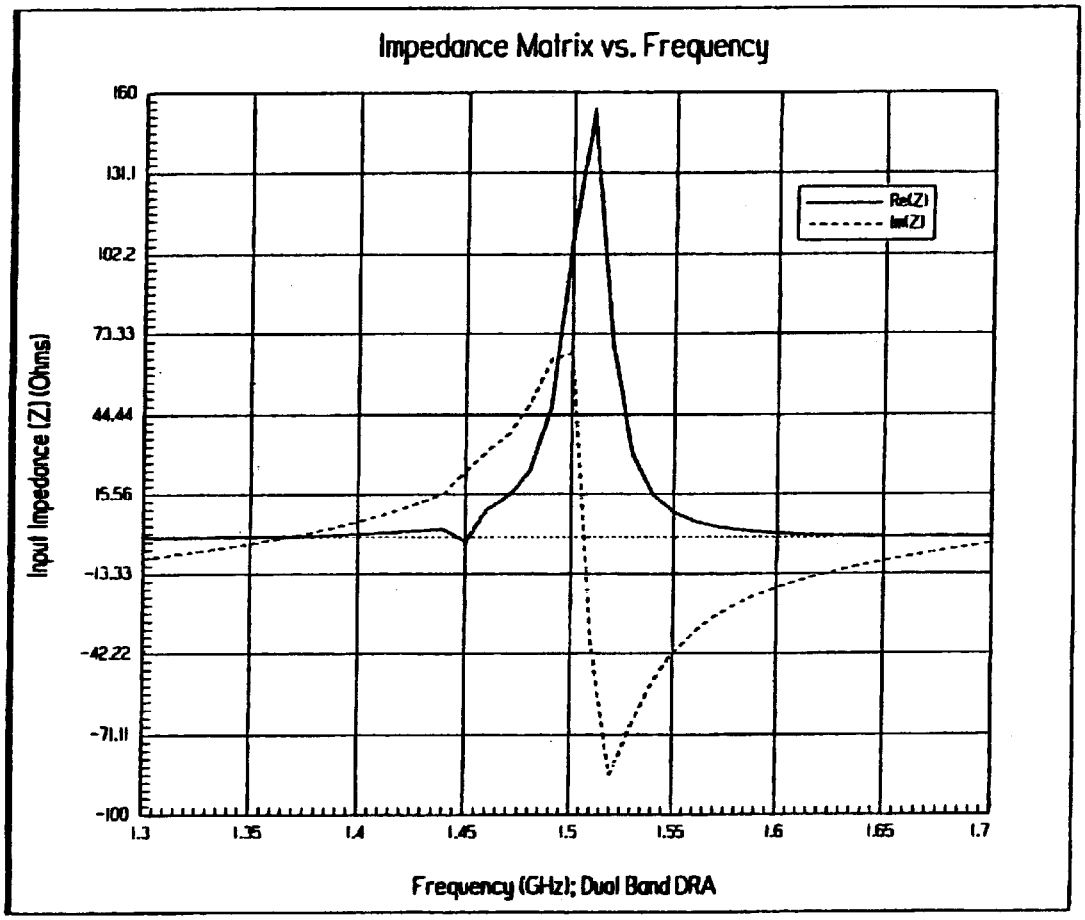
FIG. 7 illustrates a computer simulated impedance vs. frequency plot of a dielectric and patch resonator antenna constructed according to the invention operating near the resonance of the patch.
Figure 8:
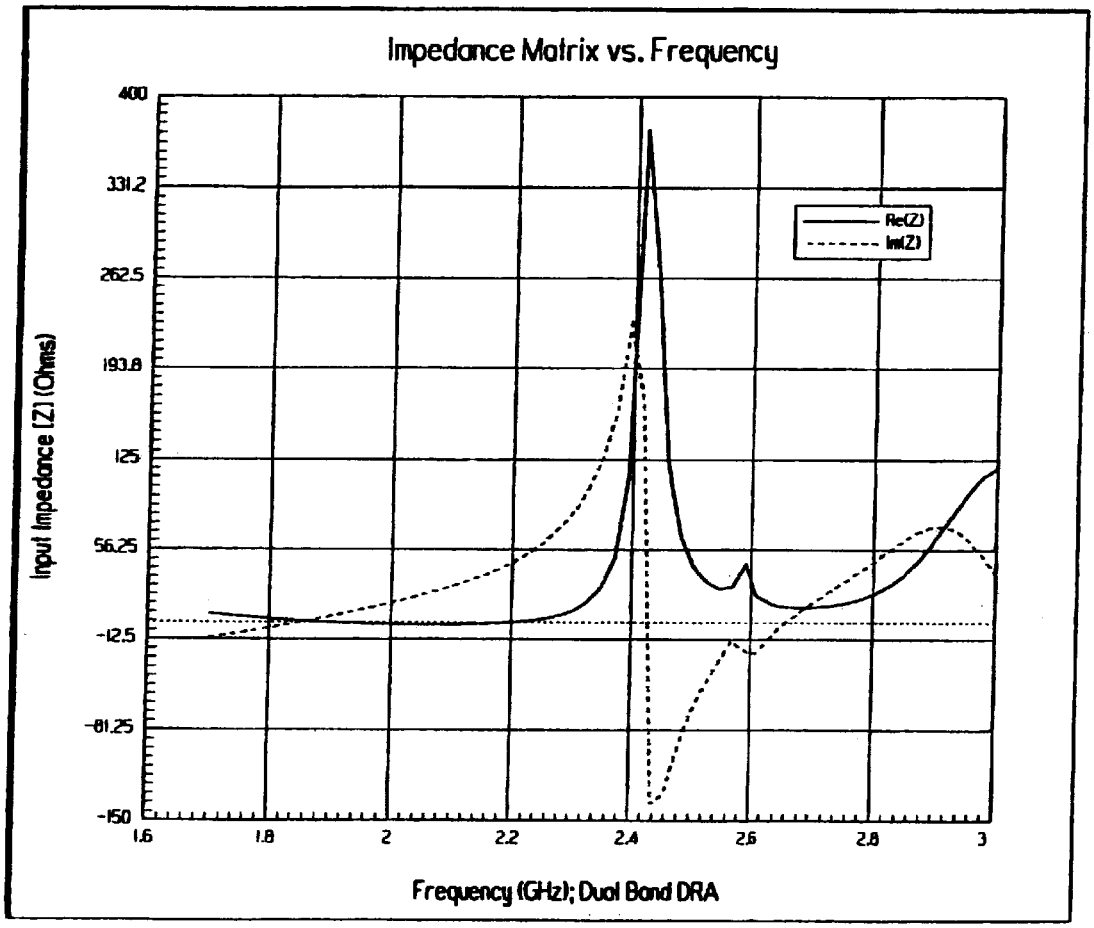
FIG. 8 illustrates a computer simulated impedance vs. frequency plot of a dielectric and patch resonator antenna constructed according to the invention operating near the resonance of the dielectric resonator.

Numerical simulation results for this design are illustrated in the graphical presentations of FIGS. 7 and 8. In FIG. 7, the resonance of the patch antenna element is seen as occurring at about 1.51 GHz. In FIG. 8, the resonance of the $HE_{11\delta}$mode for the dielectric resonator element is seen as occurring at about 2.51 GHz.

While the input impedances are very different for the two antenna elements, tuning for matching such impedances is well known in the art, and various known techniques would be used to accommodate matching these antenna elements to other circuitry as wold be clear to those skilled in the art.

V. Conclusion

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

What is claimed is:

1. A dielectric-patch resonator antenna, comprising:

a dielectric resonator formed from a dielectric material;

at least a first signal feed coupled to said first resonator;

a ground plane formed of a conductive material supporting said dielectric resonator;

a patch antenna element disposed between and in contact with said dielectric material and ground plane; and at least a second signal feed coupled to said patch element, separate from said first signal feed.

2. The antenna according to claim 1, wherein said dielectric resonator is shaped as a right cylinder, said ground plane is substantially flat over a central portion.

3. The antenna according to claim 1, further comprising at least one signal probe electrically coupled to said resonator to transfer signals to and from said resonator, and produce circularly polarized radiation in said antenna.

4. The antenna according to claim 3, wherein said probe is substantially orthogonal to said ground plane and said patch element.

5. The antenna according to claim 1, wherein said resonator is formed of a ceramic material.

6. The antenna according to claim 5, wherein the dielectric constant $\in_r$ of said ceramic material is greater than 10.

7. The antenna according to claim 1, wherein said resonator is substantially non-circular in cross section.

8. The antenna according to claim 1, further comprising a second dielectric resonator positioned on said ground plane.

9. The antenna according to claim 1. wherein said ground plane further comprises a support substrate and a layer of conductive material deposited on said substrate.

10. The antenna according to claim 9, wherein said substrate comprises a multi-layered circuit board.

11. A dual band dielectric-patch resonator antenna, comprising:

a first resonator formed of a dielectric material;

at least a first signal feed coupled to said first resonator;

a first ground plane formed of a conductive material on which said first resonator is mounted;

a patch element disposed between and in contact with said first resonator dielectric material and ground plane;

at least a second signal feed coupled to said patch element, separate from said first signal feed;

a second resonator formed of a dielectric material;

at least a third signal feed for said second resonator; and a second ground plane formed of a conductive material on which said second resonator is mounted, said first and second ground planes being separated from each other by a predetermined distance.

12. The dual band antenna according to claim 11, further comprising first and second probes electrically coupled to each of said resonators spaced approximately 90 degrees apart around the perimeter of each resonator providing first and second signals, respectively, to each resonator, wherein each of said resonators resonates in a predetermined frequency band that differs between said resonators.

13. The dual band antenna according to claim 11, further comprising support members for mounting said first and second ground planes in spaced apart relation with a predetermined separation distance such that the central axes of said resonators are substantially aligned with each other.

* * * * *